United States Patent [19]

Schneider

[11] 4,230,287

[45] Oct. 28, 1980

[54] APPARATUS FOR THE MECHANICAL NEEDLING OF PILE FABRICS

[75] Inventor: Axel Schneider, Krefeld, Fed. Rep. of Germany

[73] Assignee: Scheibler Peltzer GmbH & Co., Krefeld, Fed. Rep. of Germany

[21] Appl. No.: 970,797

[22] Filed: Dec. 18, 1978

[30] Foreign Application Priority Data

Dec. 17, 1977 [DE] Fed. Rep. of Germany ..... 2756468

[51] Int. Cl.[3] ..... B65H 75/02

[52] U.S. Cl. ..... 242/77.1

[58] Field of Search ..... 242/77.1, 62; 206/389, 206/407, 408; 24/87 R

[56] References Cited

U.S. PATENT DOCUMENTS

| | | | |
|---|---|---|---|
| 2,944,752 | 7/1960 | Schwartz | 242/77.1 X |
| 3,071,245 | 1/1963 | Schwartz | 242/77.1 |
| 3,102,700 | 9/1963 | Lemieux | 242/77.1 X |
| 3,674,222 | 7/1972 | Smiley | 242/77.1 |
| 4,074,874 | 2/1978 | Kessler | 242/62 |

*Primary Examiner*—Edward J. McCarthy
*Attorney, Agent, or Firm*—Shlesinger, Arkwright, Garvey and Dinsmore

[57] ABSTRACT

An apparatus for the mechanical needling of pile fabrics onto a winding frame comprising a pair of rotatable suspension frames located at opposite ends of an axle and including radially disposed rows of fabric engaging hooks movable parallel to the axle, actuating means for moving the individual hooks toward the opposite end of the axle in sequence beginning with the radially innermost hooks and progressing to the radially outermost hooks in synchronization with the rotation of the suspension frames, the actuating means including ejector means rotatable with the suspension frames and cam means selectively movable into the path of movement of the ejector means for selectively moving the individual hooks toward the opposite end of the axle.

16 Claims, 4 Drawing Figures

APPARATUS FOR THE MECHANICAL NEEDLING OF PILE FABRICS

The invention relates to an apparatus for the mechanical needling of pile fabrics onto a winding frame which is rotatably clamped in the apparatus and which has two suspension frames arranged at the ends of an axle and which have radially extending hook belts each comprising a row of individual hooks, the apparatus having actuating devices for moving the individual hooks sequentially from the inside to the outside towards the suspension frame located opposite in each case and in dependence upon the revolutions of the winding frame.

It is known that the surface of pile fabrics is very sensitive to pressure, so that fabrics of this type must not be simply rolled up for the purpose of transportation. Therefore, for this purpose, the individual layers of the fabric are needled on special winding frames at a distance from one another. For this purpose, the winding frames have, at the ends of an axle, suspension frames in which usually four radially extending hook belts, each having a large number of hooks, are located. During needling, the edges of the pile fabric are inserted from the inside to the outside into the hooks, the radial distance between the hooks ensuring that the sensitive surfaces of the fabric do not abut against one another. The needling operation is effected manually, and is thus very time-consuming.

German Offenlegungsschrift No. 24 08 590 describes, for the first time, a winding frame which permits mechanical needling owing to the splitting up of the hook belts into individual hooks and the axial displaceability thereof. By means of a device developed for this purpose, a rotary movement is imparted to the winding frame for this purpose, wherein during each revolution, an oscillating pivoted finger in each case withdraws a hook of the hook belts from a slot into a position in which the edges of the incoming pile fabric automatically engage the hooks. However, this apparatus has not proved to be fully suitable for mechanical needling, particularly at high speeds, since, under these circumstances, it lacks the required accuracy and stability.

Therefore, the object of the invention is to design an apparatus of the type mentioned initially such that satisfactory needling of the pile fabrics is ensured even at high winding speeds.

In accordance with the invention, this object is achieved in that the actuating devices in each case act upon the rear of the hooks and have ejector elements which rotate therewith and at least one cam which, for the purpose of actuating the ejector element associated with the individual hook or hooks to be ejected, is movable into the path of movement of the ejector element by way of an adjusting device. By moving the cam or cams into the path of movement of the respective ejector element, the latter is moved such that the hook actuated thereby, or alternatively, a group of hooks, is pushed towards oppositely located suspension frame and thus arrives in the entry region of the pile fabric, so that the edges of the fabric engage the tips of the hooks.

Compared with the embodiment known hitherto, this type of actuating device has the advantage that it operates very accurately even at high winding speeds, especially since, by corresponding dimensioning, it can be constructed with great stability. Moreover, the cam control has the advantage that it can be largely freely adapted in conformity with requirements by corresponding configuration of the parts running against one another.

In a development of the invention, the free ends of the ejector elements of the individual hooks (20), which are equidistant from the axle (7) of the winding frame, are located on circles located concentrically of the axle.

In accordance with a further feature of the invention, the ejector elements are in the form of push rods. Push rods of this type can be accommodated in a particularly space-saving manner and relieve the individual hooks from shearing forces.

Furthermore, in accordance with the invention, the ejector elements are in the form of axially pivotable ejector levers which, if required, are additionally arranged between push rods and the cam or cams. Alternatively, the ejector elements can be in the form of ejector rollers or ejector balls which may also be additionally arranged between the push rods and the cam or cams. These ejector rollers or ejector balls satisfactory absorb the transverse forces occurring when running onto the cam, so that the individual hooks or their push rods are not subjected to bending or shearing forces.

In accordance with the invention, a further alternative for the construction of the ejector elements resides in designing them in the form of axially movable ejector rings arranged concentrically of the axle of the winding frame, wherein these ejector rings may also be additionally arranged between the push rods and the cam or cams. It is advantageous for the ejector rings to be individually and axially displaceable, so that upon their displacement, all the individual hooks, which are equidistant from the axle of the winding frame, are pushed into the needling position.

In a further development of the invention, the ejector rings have a number of run-on lugs corresponding to the number of cams commonly actuating the ejector rings at any given time. Thus, it is possible to move the cam or cams into the path of movement of the ejector rings without the ejector rings first being actuated. The particular ejector ring is moved in an axial direction only when the run-on lugs come into contact with the cam or cams. This has the advantage that the cam or cams can be moved into the range of movement of the ejector rings without a large expenditure of force, since the ejector rings are then still not actuated, although the ejector rings are still actuated at the exactly predetermined instant and with a correspondingly adapted speed and acceleration by corresponding adaptation of the run-on lugs relative to the cams.

Furthermore, in accordance with the invention, at least two commonly actuable cams located opposite one another are provided for the ejector elements, it being advisable to provide four cams uniformly distributed around the periphery of the ejector rings. As a result of this, the ejector elements in each case located on a circle are simultaneously pushed into the needling position. However, this arrangement is particularly advantageous when ejector rings are used as ejector elements, since the risk of tilting upon actuating the ejector rings is virtually eliminated. Namely, the ejector rings are accurately pushed in an axial direction without unilateral stresses.

In a further development of the invention, at least one cam is provided for the ejector elements which are located on a circle concentric to the axle of the winding frame. This has the advantage that the respective cams only have to be moved slightly in order to enter the range of movement of the ejector elements. It is then advantageous to provide for each circle, corresponding to the number of cams, a rotatable cam cylinder which extends radially beyond the circles and whose outer surface is provided with cams which are distributed around the periphery at distances apart corresponding to the circles. The ejector elements are successively actuated from the inside to the outside by stepwise rotation of this cam cylinder or these cam cylinders.

The stepwise control of the ejector cylinder can be effected by providing a stepping mechanism for the adjusting device for the cam cylinder or cam cylinders. By way of example, this stepping mechanism may be in the form of a stepping motor which is preferably programmable.

The invention will be further described with references to an embodiment illustrated in the drawings, in which.

Figure 1:
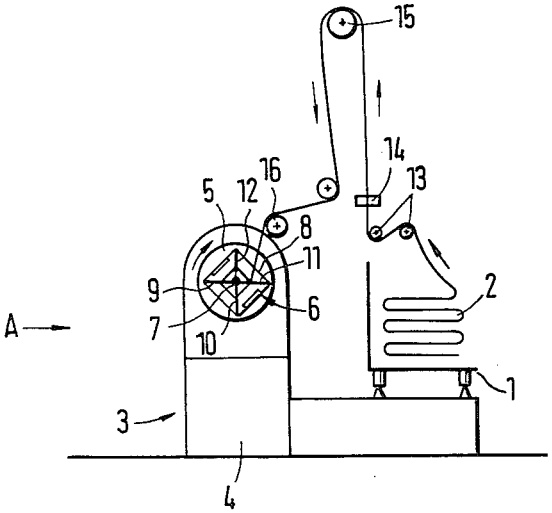
FIG. 1 is a side elevation of an apparatus for the mechanical needling of pile fabrics.

FIG. 1 is a side elevation of an apparatus for the mechanical needling of pile fabrics onto a winding frame. This apparatus essentially comprises a depository 1 for the stacked pile fabric 2, and a winding device 3. The winding device 3 has a machine frame 4 which is U-shaped when viewed in the direction of the arrow A, a winding frame 6 for the needling process being rotatably clamped between the limbs of the U-shaped winding device 3 which carry the winding heads 5.

The winding frame 6 comprises an axle 7 at each end of which is arranged a suspension frame 8 which has a square configuration and which is provided with diagonal spokes. These spokes are provided with a plurality of hook belts 9, 10, 11, 12 which comprise individual hooks and onto which the pile fabric 2 is needled by engaging the two edges of the pile fabric.

For the purpose of this needling operation, the pile fabric 2 is drawn from the depository 1 and first runs through a pair of compensating rollers 13 and a control 14 for the web of cloth for the purpose of avoiding lateral displacement, and then over a tensioning roller 15 for tensioning the pile fabric, and finally over a stretching roller 16 which is of dished construction, so that the pile fabric 2 stretches outwardly under the action of the tension. Prepared in this manner, the two edges of the pile fabric 4 are successively engaged by the individual hooks of the hook belts 9, 10, 11, 12.

Figure 2:
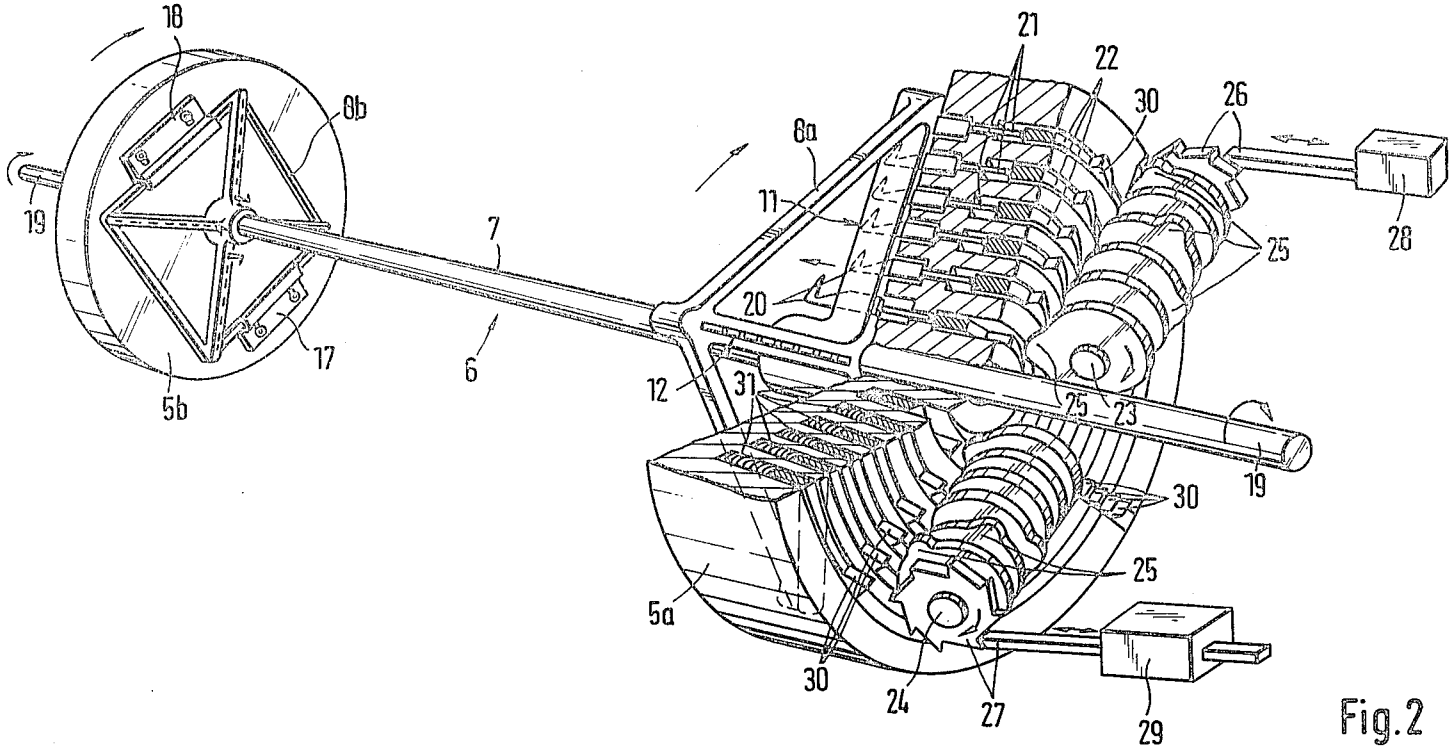
FIG. 2 is a perspective view of a winding frame having the winding head of the apparatus illustrated in FIG. 1.

FIG. 2 is a perspective view, together with a fragmentary section of the winding head 5*a*, of the winding frame 6 having the suspension frames 8*a*, 8*b* arranged one at each end of the axle 7. The two suspension frames 8*a*, 8*b* are clamped, by means of securing clamps 17, 18 (visible only on the suspension frame 8*b*), between the winding heads 5*a* and 5*b* which are rotatable by means of a drive shaft 19. Since the two winding frames 8*a*, 8*b*, and also the two winding heads 5*a* and 5*b*, are of identical construction, the description is hereinafter confined to the sectionally illustrated winding head 5*a*, the description also applying to the winding head 5*b* located opposite the winding head 5*a*.

The individual hooks 20 (drawn to an enlarged scale in the present instance) of the hook belts 11, 12 are displaceably mounted in radially extending slots in the spokes of the suspension frame 8*a*. When in a non-ejected position, the tips of the hooks project only slightly from the suspension frame 8*a*, while their rear ends extend into corresponding recesses in the winding head 5*a*, as will be seen from the cross-section. For the sake of clarity, only six individual hooks per hook belt are illustrated.

The rear end of each individual hook 20 abuts against a push rod 21 extending axially through the winding head 5*a*. The rear ends of the push rods 21 abut against ejector rings 22 which are axially displaceably arranged in annular-groove-like slots in the winding head 5*a* concentrically of the drive shaft 19. An ejector ring 22 is provided for each of the individual hooks 20 of the four hook belts 9, 10, 11, 12, which are equidistant from the axle 7 of the drive shaft 19, that is to say, six ejector rings are provided in the present embodiment. Thus, by displacing one of the ejector rings 22 towards the respective, oppositely located suspension frame 8*b*, four push rods 21 with the associated individual hooks 20 are simultaneously ejected from the suspension frame 8*a* to an extent shown in this Figure in the case of the inner individual hooks 20, so that the edges of the incoming pile fabric is engaged by these ejected individual hooks 20. The other three individual hooks 20, which are also in an ejected position, are concealed in this Figure. After one revolution of the winding frame 6 (alternatively, it can also be two), the outwardly adjacent ejector ring 22 in each case is pushed in the same direction, so that the respective outwardly adjacent individual hooks 20 are pushed out into the needling position and can be engaged by the edges of the pile fabric 2. Thus, the pile fabric 2 is wound up from hook to hook corresponding to the distance between the individual hooks 20 in a radial direction, without the individual layers coming into contact with one another. When two revolutions take place up to the next ejection operation, two layers are picked up in a corresponding manner per hook, so that these two layers do, in fact, come into contact with one another. However, the pressure of the webs of fabric is so slight that, even in this case, careful transportation is still ensured.

A total of four radially extending, equally spaced cam cylinders 23, 24 of identical construction are provided for actuating the ejector rings 22 and thus the push rods 21 and the individual hooks 20 in the manner described above, only two cam cylinders being illustrated for the sake of clarity. The surfaces of the cam cylinders 23, 24 are provided with cams 25 which are spaced apart by a distance corresponding to the radial spacing of the ejector rings 22 and which are offset relative to one another by equal angular degrees. The cam cylinders 23, 24 are rotated in a stepwise manner by respective stepping motors 28, 29 by way of respective pawl drives 26, 27 such that the cams 25, equidistant from the drive shaft 19, come into contact with the corresponding ejector ring 22 and displace the latter in the direction of ejection. As a result of stepwise further rotation of the cam cylinders 23, 24 in dependence upon the revolutions of the winding frame 6, the further externally located cams 25 come into contact with the corresponding further externally located ejector rings 22 in each case, so that the ejector rings 22 are displaced successively from the inside to the outside in the direction of ejection. In this manner, the individual hooks 20 are automatically pushed in this sequence from the suspension frame 8 into the needling position, so that needling can be effected automatically without further manual assistance.

In order to actuate the ejector rings 22 more accurately and more readily, the ejector rings have run-on lugs 30 which are uniformly distributed around the peripheries thereof, the number of which run-on lugs on each ejector ring 22 corresponds to the number of cam cylinders 23, 24. In this manner, the cam 25 on the cam cylinders 23, 24 can pivot into the space between two run-on lugs 30 without first coming into contact with the rear of the ejector rings 22. The cams 25 come into contact with the respective ejector ring 22 by way of run-on lugs 30 only as a result of further rotation of the winding head 5*a* and thus of the ejector rings 22, so that the ejector ring is displaced in the direction of ejection. The individual ejector rings 22 are always displaced simultaneously, since the run-on lugs 30 are arranged at the same distance apart as the cam cylinders 23, 24, so that each individual ejector ring is axially displaced with a four-fold support at its periphery. This support avoids tilting and jamming. After displacement in the direction of ejection, the ejector rings 22 return to their normal positions under the action of springs 31.

Figure 3:
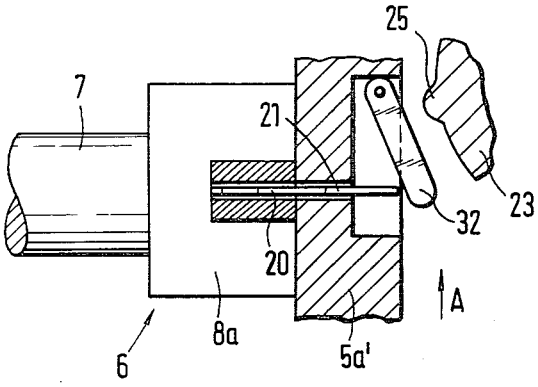
FIG. 3 is a fragmentary section through another embodiment of the winding head.
Figure 4:
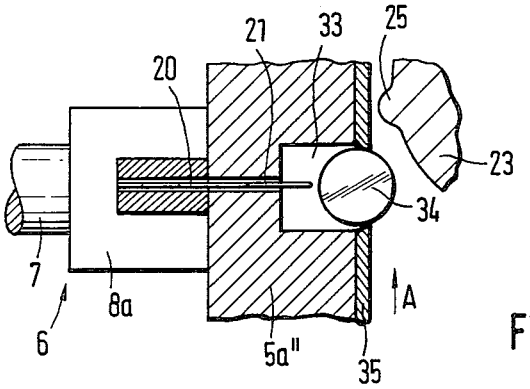
FIG. 4 is a fragmentary section through a further embodiment of the winding head.

FIGS. 3 and 4 each show in fragmentary sections, whose sectional planes extend segmentally parallel to the tangential on the periphery of the winding head 5*a'* and 5*a''* respectively, a different embodiment of the winding head 5*a'*, 5*a''* which differs from the embodiment illustrated in FIG. 2 particularly by virtue of different ejector elements.

Referring to FIG. 3, the ejector element forms an ejector lever 32 which is mounted in the winding head 5*a'* to pivot about a radially extending swivel axis and, extending in a circumferential direction, projects outwardly at the rear of the winding head 5*a'*. The ejector lever projects to such an extent that upon a further rotary movement in the direction of the arrow A, it strikes against the cam 25 of the cam cylinder 23 which has moved into its path of movement and is thereby pivoted in an axial direction. The push rod 21 and the individual hook 20 abutting thereagainst are thereby pushed out of the spoke of the suspension frame 8*a* by the ejector lever, so that the incoming web of pile fabric (not shown) is gripped by the tip of the hook. A spring (not illustrated) allows the ejector level 32 to pivot back to its illustrated position when the ejector lever is no longer acted upon by the cam 25.

FIG. 4 shows a further variant of the ejector element. In this instance, instead of the ejector lever 32 (FIG. 3), an ejector roller 34 is guided in a groove 33 and, also by means of a spring (not shown), is pressed out of the grooves 33 to an extent where it projects rearwardly out of the winding head 5*a''*. To prevent the ejector roller from springing out of the winding head, this rear of the winding head 5*a''* is covered by a retaining plate 35 which has rectangular holes for the ejector rollers 34, the cross section of which holes is smaller that that of the ejector roller 34 in a circumferential direction.

Upon further rotation in the direction of the arrow A, the ejector roller 34 can be pressed into the groove 33 by the cam 25 of the cam cylinder 23 which is pivoted into the path of movement of the ejector roller, whereby the push rod 21 and thus the individual hook 20 are pushed out into the needling position.

A common feature of the two embodiments illustrated FIGS. 3 and 4 is that an ejector element, that is to say, either a ejector lever 32 or an ejector roller 34 is provided for each individual hook 20. There is then no need to provide several cam cylinders in the case of these ejector elements, since there is no risk of tilting in this instance.

I claim:

1. An apparatus for the mechanical needling of pile fabrics onto a winding frame comprising:

a pair of rotatable suspension frame, each suspension frame being arranged at opposite ends of an axle and including radially disposed rows of equally spaced fabric engaging hooks movable parallel to said axle and defining concentric rings of hooks, actuating means for moving the individual hooks toward the opposite end of said axle in a sequence beginning with the radially innermost hooks and progressing to the radially outermost hooks in synchronization with the rotation of said suspension frames, said actuating means including ejector means rotatable with said suspension frames, cam means movable into the path of movement of said ejector means and means for moving said cam means into the path of movement of said ejector means for selectively moving said individual hooks toward said opposite end of said axle.

2. Apparatus as claimed in claim 1, characterised in that the free ends of the individual hooks (20), which are equidistant from the axle (7) of the winding frame, are located on circles concentrically of the axle.

3. Apparatus as claimed in claim 1, characterised in that said ejector means includes push rods (21).

4. Apparatus as in claim 1 or 3, wherein said ejector means includes ejector rollers (34 ) displaceable in the direction of the winding frame axle (7).

5. Apparatus as in claim 1 or 3, wherein said ejector means includes ejector balls which are displaceable in the direction of the winding frame axle (7).

6. Apparatus as in claim 1 or 3, wherein said ejector means includes axially movable ejector rings (22) which are arranged concentrically of the winding frame axle (7).

7. Apparatus as claimed in claim 6, characterised in that said ejector rings (22) are individually and axially displaceable.

8. Apparatus as in claim 7, characterised in that said ejector rings (22) have run-on lugs (30) equal in number to the number of cams (25) which commonly actuate the ejector rings in each case.

9. Apparatus as in claim 1 or 3, and wherein said cam means includes at least two oppositely located, commonly actuatable camshafts for said ejector means.

10. Apparatus as claimed in claim 9, characterised in that four camshafts are provided for the ejector means.

11. An apparatus as in claim 1 or 3 wherein said ejector means includes axially pivotable ejector levers (32) positioned between said cam means and said hooks.

12. An apparatus as in claim 1 and wherein said cam means includes at least one cam member for each ring of hooks.

13. An apparatus as in claim 1 and wherein said cam means includes a plurality of cam shafts each having a member of cam members equal to the number of rings of hooks.

14. An apparatus as in claim 13 and wherein said means for moving said cam means includes a stepping mechanism.

15. Apparatus as claimed in claim 14, characterised in that stepping mechanism includes a stepping motor (28), (29).

16. Apparatus as claimed in claim 15, characterised in that the stepping motor (28, 29) is programmable.

* * * * *